US005291747A

United States Patent [19]

Sakai et al.

[11] Patent Number: 5,291,747

[45] Date of Patent: Mar. 8, 1994

[54] ELECTRIC CONTROL APPARATUS FOR ICE MAKING MACHINE

[75] Inventors: Tadashi Sakai, Toyoake; Yukimasa Takeda, Nagoya, both of Japan

[73] Assignee: Hoshizaki Denki Kabushiki Kaisha, Toyoake, Japan

[21] Appl. No.: 928,123

[22] Filed: Aug. 12, 1992

[30] Foreign Application Priority Data

Aug. 13, 1991 [JP] Japan ..... 3-228241
Aug. 13, 1991 [JP] Japan ..... 3-228242

[51] Int. Cl.[5] ..... F25C 1/12
[52] U.S. Cl. ..... 62/135; 62/233
[58] Field of Search ..... 62/135, 233, 347

[56] References Cited

U.S. PATENT DOCUMENTS 4,934,159 6/1990 Sakai et al. ..... 62/347
4,982,573 1/1991 Tatematsu et al. ..... 62/135
4,986,081 1/1991 Hida et al. ..... 62/135 X
5,027,610 7/1991 Hara ..... 62/233 X

FOREIGN PATENT DOCUMENTS 64-2137 1/1989 Japan .

*Primary Examiner*—William E. Tapolcai
*Attorney, Agent, or Firm*—Nikaido, Marmelstein, Murray & Oram

[57] ABSTRACT

An electric control apparatus for an ice making machine includes an initial water supply cycle control device for opening a water valve for a predetermined time, and a water level sensor mounted within a water tank for detecting whether or not a level of water in the water tank is more than a predetermined level. A first check-up device is provided for permitting operation of a defrost/water supply cycle and an ice making cycle when the level of water in the water tank exceeds the predetermined level after an initial water supply cycle is conducted under control of an initial water supply control device. The first check-up device also repeats operation at the initial water supply cycle when the level of water in the water tank is less than the predetermined level. A second check-up device permits operation of the ice making cycle when the level of water in the water tank exceeds the predetermined level after the defrost/water supply cycle, and repeats operation at the initial water supply cycle when the level of water in the water tank is less than the predetermined level after the defrost/water supply cycle.

8 Claims, 13 Drawing Sheets

ELECTRIC CONTROL APPARATUS FOR ICE MAKING MACHINE

BACKGROUND OF THE INVENTION

1. Field of the Invention

The present invention relates to an ice making machine in which ice cubes are automatically produced by alternate operation at a defrost/water supply cycle and an ice making cycle, and more particularly to an electric control apparatus for the ice making machine in which a countermeasure is taken for shortage of ice making water in a water tank caused by suspension of the service water.

2. Description of the Prior Art

As disclosed in Japanese Utility Model Publication No. 64-2137, a conventional ice making machine of this kind is designed to repeatedly conduct a defrost/water supply cycle and an ice making cycle for automatically producing ice cubes, to detect whether or not a sufficient amount of water is stored in a water tank at the end of the defrost/water supply cycle, and to prohibit the ice making cycle if a sufficient amount of water is not stored in the water tank and repeatedly conduct the defrost/water supply cycle. During operation of the ice making machine at the defrost/water supply cycle, however, a compressor is activated and a hot gas valve is opened. Accordingly, if the water tank may not be supplied with fresh water due to suspension of the service water, electric power is uselessly consumed, and the compressor can become overheated.

SUMMARY OF THE INVENTION

It is, therefore, an object of the present invention to provide an electric control apparatus capable of avoiding unnecessary consumption of electric power and overheating of the compressor in situations where the water tank is not be supplied with fresh water due to the user's error or suspension of the service water or the ice cubes may not be produced at the ice making cycle due to shortage of the fresh water in the water tank.

Another object of the present invention is to provide an electric control apparatus for an ice making machine capable of avoiding useless consumption of water in the case that the water tank may not be sufficiently filled with fresh water due to leakage of the supplied water.

A further object of the present invention is to provide an electric control apparatus for the ice making machine capable of deactivating the compressor to save electric power in case a shortage of fresh water in the water tank continues for a long time due to suspension of the service water, or leakage of the supplied water, and of automatically activating the ice making machine in the case that shortage of fresh water in the water tank can be recovered within a short time.

According to the present invention, an electric control apparatus for an ice making machine is provided, having an upright ice making plate arranged above a water tank, an evaporator mounted to a rear surface of the ice making plate, a refrigeration circuit including a compressor, a cooling device and an expansion valve for circulating refrigerant into the evaporator, and a hot gas valve disposed within a bypass line of the refrigerant circuit to be opened for supplying hot gas from the compressor into the evaporator. A water pump is arranged to supply fresh water from the water tank to a front side upper portion of the ice making plate, and a water valve is arranged to control the supply of fresh water from an external source of water to a rear side upper portion of the ice making plate. The electric control apparatus includes defrost/water supply cycle control means for opening the hot gas valve and water valve for a predetermined time in a condition where the compressor is being activated while the water pump is deactivated, ice making cycle control means for activating the water pump for a predetermined time in a condition where the compressor is being activated while the hot gas valve and water valve are closed, and means for alternately conducting a defrost/water supply cycle and an ice making cycle under control of the defrost/water supply cycle control means and the ice making cycle control means. The electric control apparatus also includes initial water supply cycle control means for opening the water valve for a predetermined time prior to the defrost/water supply cycle and the ice making cycle in a condition where the compressor and water pump are deactivated, and a water level sensor mounted within the water tank for detecting whether or not the level of water in the water tank is more than a predetermined level. First checkup means are provided for permitting operation at the defrost/water supply cycle and the ice making cycle when the level of water in the water tank is more than the predetermined level, after an initial water supply cycle is conducted under control of the initial water supply control means and for repeating operation at the initial water supply cycle when the level of water in the water tank is less than the predetermined level. Second checkup means are provided for permitting operation at the ice making cycle when the level of water in the water tank is more than the predetermined level after the defrost/water supply cycle and for repeating operation at the initial water supply cycle when the level of water in the water tank is less than the predetermined level after the defrost/water supply cycle.

According to an aspect of the present invention the electric control apparatus further comprises control means for deactivating the compressor and water pump and closing the hot gas valve and water valve for a predetermined time prior to operation at the initial water supply cycle conducted under control of the first checkup means.

According to another aspect of the present invention, there is provided the electric control apparatus wherein the first checkup means is modified to stop the ice making machine when the level of water in the water tank is less than the predetermined level after the initial water supply cycle.

According to a further aspect of the present invention, there is provided the electric control apparatus wherein the second checkup means is modified to stop the ice making machine when the level of water in the water tank is less than the predetermined level after the defrost/water supply cycle.

According to a still another aspect of the present invention, there is provided the electric control apparatus wherein the second checkup means is replaced with counting means for counting the number of times of the initial water supply cycle is conducted under control of the first checkup means, and means for stopping the ice making machine when the counted number of times the initial water supply cycle is conducted reaches a predetermined value.

According to a further aspect of the present invention, the second checkup means is replaced with measuring means for measuring a duration of the initial water supply cycle and with means for stopping the ice making machine when the measured duration reaches a predetermined time.

DESCRIPTION OF THE PREFERRED EMBODIMENTS

Figure 1:
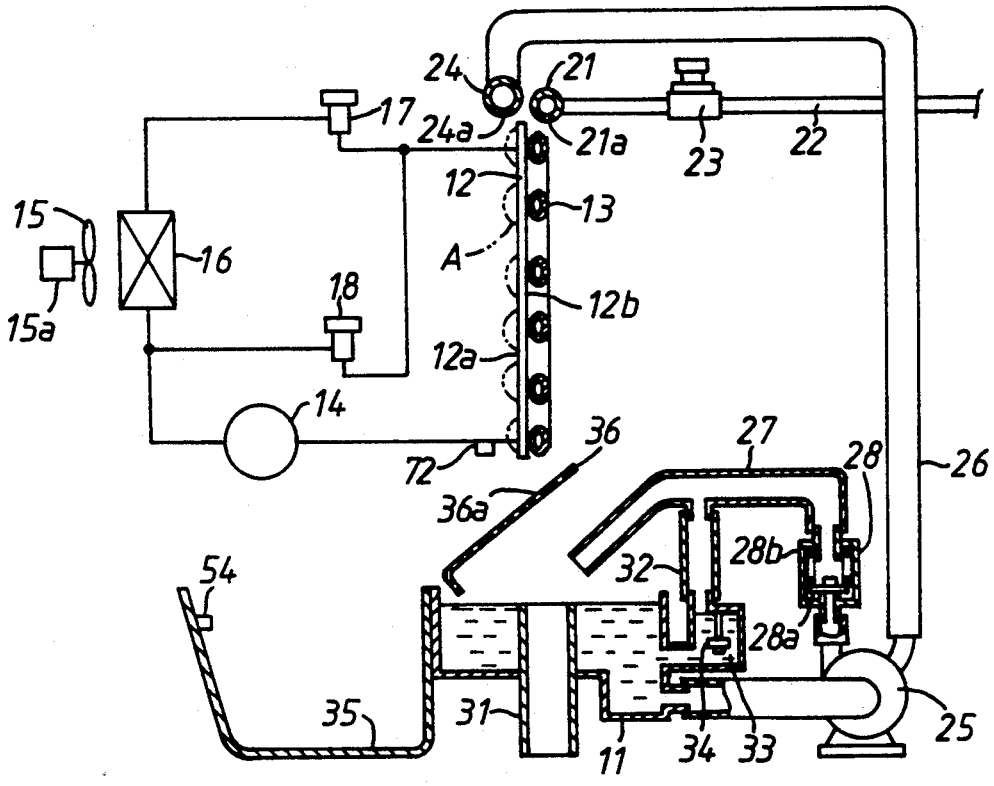
FIG. 1 is a schematic illustration of an ice making machine.

Referring to the drawings, a preferred embodiment of the present invention will be described hereinafter. FIG. 1 illustrates an ice making machine which includes water tank 11 arranged to store an amount of ice making water, and an upright ice making plate 12 of stainless sheet metal located above the water tank 11 to form ice cubes A on its front surface 12*a*. An evaporator coil 13 is welded to a rear surface of ice making plate 12 and is connected at its inlet to an expansion valve 17 and at its outlet to a refrigerant compressor 14. In a refrigeration circuit of the ice making machine, the compressor 14 is connected at its outlet to a finned condenser 16 provided with a cooling fan 15 driven by an electric motor 15*a*, and the condenser 16 is connected at its outlet to the expansion valve 17. The compressor 14 is further connected at its outlet to the downstream side of expansion valve 17 by way of a bypass line provided with an electrically operated hot gas valve 18 of the normally closed type. Arranged above the rear surface 12*b* of ice making plate 12 is a watering pipe 21 which is connected to a water service pipe 22 through an electrically operated water valve 23 of the normally closed type. When supplied with fresh water from the water service pipe 22 through the water valve 23, the watering pipe 22 supplies water from its sprinkler holes 21*a* such that it flows along the rear surface 12*b* of ice making plate 12 as defrost water.

Arranged above the front surface 12*a* of ice making plate 12 is a watering pipe 24 which is connected to a water pump 25 through a water supply pipe 26. When supplied with ice making water from the water supply pipe 26 in operation of the water pump 25, the watering pipe 24 allows the supplied ice making to water flow down from its sprinkler holes 24*a* along the front surface 12*a* of ice making plate 12. The water pump 25 is driven by a reversible electric motor to supply the ice making water into the water supply pipe 26 from the water tank 11 in its forward rotation and to supply the ice making water into a discharge pipe 27 from the water tank 11 in its reverse rotation. The discharge pipe 27 is provided with a pressure valve 28 which includes a valve body 28*a* loaded by a compression spring 28*b* downward to be normally closed. When applied with the water under pressure from the water pump 25, the valve body 28*a* is moved against the load of spring 28*b* to permit the flow of water into the discharge pipe 27. The outlet end of discharge pipe 27 is placed above an overflow pipe 31 disposed within the water tank 11 to discharge the ice making water therethrough.

The discharge pipe 27 is connected to a sub-tank 33 through a pipe 32 to direct a portion of the supplied water flow into the sub-tank 33. The sub-tank 33 is communicated at its bottom portion with the water tank 11, and contains therein a float switch 34 which is arranged to be closed when the level of water in tank 11 becomes higher than a predetermined level float switch 34 is opened when the level of water in tank 11 becomes lower than the predetermined level. A perforated water plate 36 is tiltably arranged above the water tank 11 to permit the water flowing down therethrough to flow into the water tank 11 from the ice making plate 12 and to receive ice cubes released from the ice making plate 12.

Figure 2:
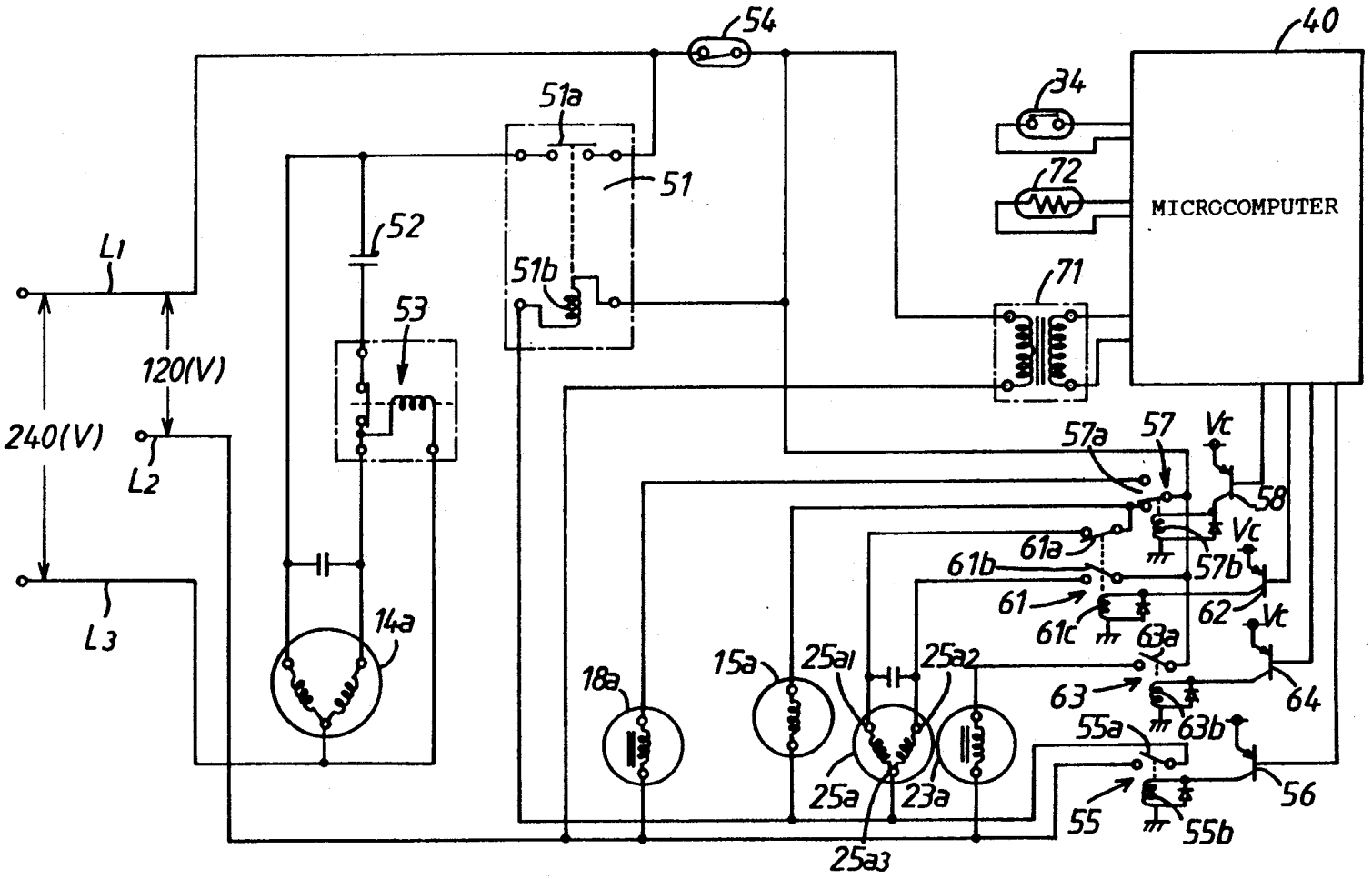
FIG. 2 is an electric control apparatus for the ice making machine shown in FIG. 1.

As shown in FIG. 2, an electric control apparatus for the ice making machine has three input buses $L_1$, $L_2$, $L_3$ connected to an electric motor 14*a* of the refrigerant compressor 14, a solenoid 18*a* of hot gas valve 18, the electric motor 25*a* of water pump 25, a solenoid 23*a* of water valve 23 and a control circuit 40 for the electric motors and solenoids. The input buses $L_1$, $L_2$, $L_3$ are connected to a commercially available single-phase three-wire type power source. In this embodiment, the input buses $L_1$, $L_2$ are arranged to be supplied with a source voltage of 120 volts, while the input buses $L_1$, $L_3$ are arranged to be supplied with a source voltage of 240 volts.

The electric motor 14*a* of compressor 14 is connected at its one end to the input bus L1 through a normally open contact of a relay switch 51 and at its other end to the input bus L3. Interposed between the normally open contact 51*a* and the electric motor 14*a* are a drive capacitor 52 and a start relay 53. The normally open contact 51*a* is associated with a relay coil 51*b* which is connected at its one end to the input bus L1 through a thermostat switch 54 and at its other end to the input bus L2 through a normally open contact 55*a* of a relay switch 55. When supplied with the source voltage 120 volts, the relay coil 51 is energized to close the normally open contact 51*a*. As shown in FIG. 1, the thermostat switch 54 is mounted on an inside upper portion of an ice stocker 53 to be opened at a predetermined temperature when the ice stocker 53 has been filled with ice cubes. The normally open contact 55*a* of relay switch 55 is associated with a relay coil 55*b* which is grounded at its one end and connected at its other end to the collector of a switching transistor 56. When applied with a DC voltage Vc in response to energization of transistor 56, the relay coil 55*b* is energized to close the normally open contact 55*a*.

The solenoid 18*a* of hot gas valve 18 and the motor 15*a* of cooling fan 15 are connected at their one ends to the input bus $L_1$ through a movable contact 57*a* of a relay switch 57 and the thermostat switch 54. The solenoid 18*a* of hot gas valve 18 is connected at its other end to the input bus $L_2$, while the motor 15*a* of cooling fan 15 is connected at its other end to the input bus L2 through the normally open contact 55*a* of relay switch 55. The movable contact 57*a* is retained in a first position during deenergization of the relay coil 57*b* to connect the electric motor 15*a* of cooling fan 15 to the input bus L1 and is switched over in response to energization of the relay coil 57*b* from the first position to a second position to connect the solenoid 18*a* of hot gas valve 18 to the input bus $L_1$. The relay coil 57*b* is grounded at its one end and connected at its other end to the collector of a switching transistor 58 to be energized when the transistor 58 is turned on.

The electric motor 25a of water pump 25 has a first control terminal $25a_1$ for forward rotation connected to the input bus $L_1$ through a normally closed contact 61a of a relay switch 61, the movable contact 57a of relay switch 57 and the thermostat switch 54, a second control terminal $25a_2$ for reverse rotation connected to the input bus $L_1$ through a normally open contact 61b of relay switch 61 and the thermostat switch 54, and a common terminal $25a_3$ connected to the input bus L2 through the normally open contact 55a of relay switch 55. The relay switch 61 includes a relay coil 61c which is grounded at its one end and connected at its other end to the collector of a switching transistor 62. The normally closed contact 61a is opened in response to energization of the relay coil 61c, while the normally open contact 61b is closed in response to energization of the relay coil 61c. The solenoid 23a of water valve 23 is connected at its one end to the input bus L1 through a normally open contact 63a of a relay switch 63 and the thermostat switch 54 and at its other end to the input bus $L_2$. The relay switch 63 includes a relay coil 63b which is grounded at its one end and connected at its other end to the collector of a switching transistor 64. When the transistor 64 is turned on, the relay coil 63b is energized to close the normally open contact 63a.

Figure 3:
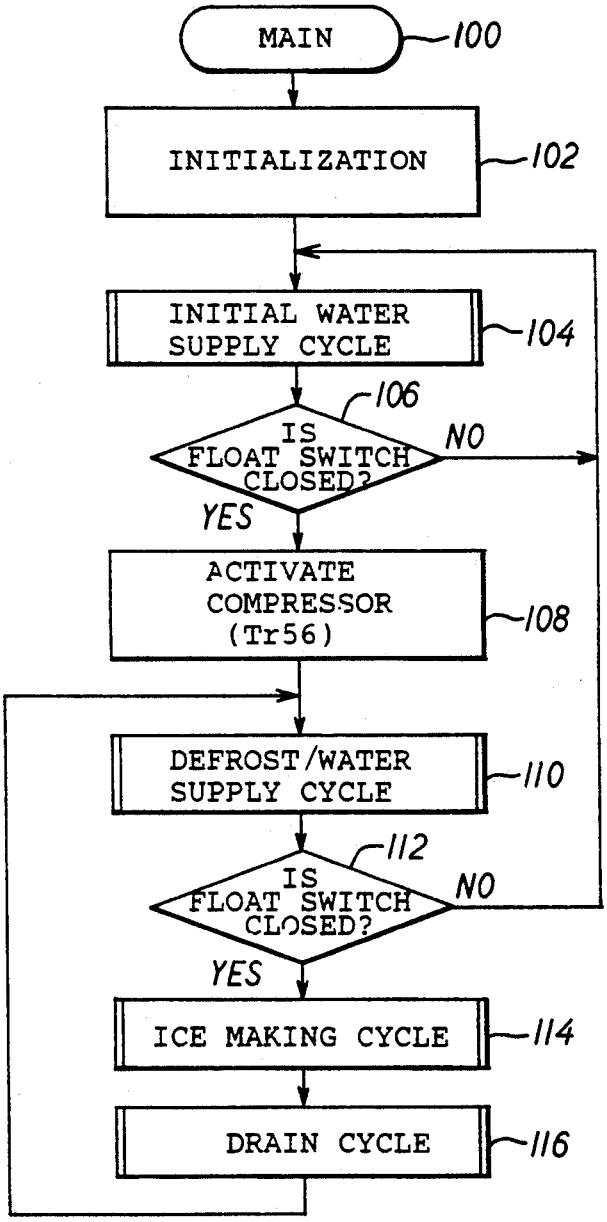
FIGS. 3 to 9 illustrate a flow chart of a control program executed by a microcomputer shown in FIG. 2.
Figure 9:
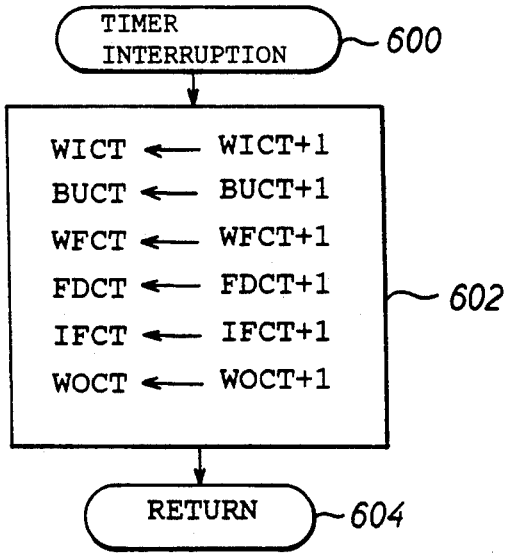

The electric control circuit 40 is in the form of a microcomputer which is arranged to execute a main control program shown by a flow chart in FIG. 3 and to execute a timer interruption program, shown by a flow chart in FIG. 9, for control of switching transistors 56, 58, 62, 64 when applied with an interruption signal from a timer at a predetermined time interval. The computer is connected to a power source transformer 71, the float switch 34 in subtank 33, and a thermal sensor 72. The transformer 71 is interposed between the input buses $L_1$ and $L_2$ through the thermostat switch 54 to supply electric power to the computer 40. As shown in FIG. 1, the thermal sensor 72 is provided on an outlet portion of evaporator 13 to produce an electric signal indicative of a temperature of refrigerant discharged from evaporator 13.

Hereinafter, the operation of the electric control apparatus will be described in detail. Assuming that a power source switch (not shown) has been closed to supply electric power to the computer 40 through the input buses $L_1$, $L_2$, $L_3$ and the transformer 71, the computer 40 is activated to initiate execution of the main control program at step 100 shown in FIG. 3. In a condition where the ice stocker 35 is not yet filled with ice cubes, the thermostat switch 54 is still opened to prohibit the supply of electric power to the computer 40. When the program proceeds to step 102, the computer 40 initializes a number of variables for execution of the main control program. When applied with an interruption signal from the timer during execution of the main control program, the computer 40 initiates execution of the interruption program at step 600 shown in FIG. 9. At step 602 of the interruption program, the computer 40 counts up a water supply count value WICT, a backup count value BUCT, a count value WFCT for detecting finish of the water supply cycle, a defrost count value FDCT, an ice making count value IFCT and a drain count value WOCT, respectively with "1". At the following step 604, the computer 40 finishes the execution of the interruption program and executes the main control program shown in FIG. 3.

Figure 4:
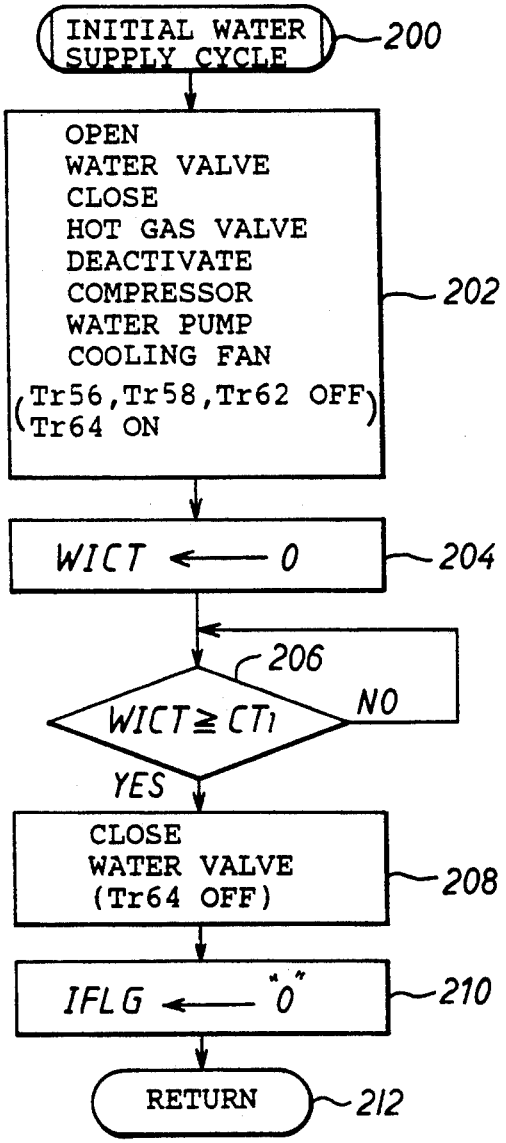

At step 104 of the main control program, the computer 40 executes an initial water supply cycle control routine. As shown in FIG. 4, the computer 40 initiates the execution of the initial water supply cycle control routine at step 200 and causes only the switching transistor 64 at step 202 to turn on. Thus, the solenoid 23a of water valve 23 is energized under control of the relay switch 63, while the electric motors 14a, 25a, 15a and solenoid 18a are maintained in their deenergized conditions under control of the relay switches 51, 55 and 57. In turn, the water valve 23 is opened to permit the supply of fresh water into the watering pipe 21 from the water service pipe 22. The fresh water falls from the watering pipe 21 along the rear surface 12b of ice making plate 12 and flows into the water tank 11. When the program proceeds to step 204, the computer 40 initially sets a water supply count value WICT to "0" and determines at step 206 whether the water supply count value WICT has been counted up to a predetermined value $CT_1$ (for example, a value indicative of 1 minute). The water supply count value WICT is counted up at each execution of the timer interruption program. Upon lapse of a predetermined time (for example, 1 minute) after processing at step 204, the computer 40 determines a "Yes" answer at step 206 and causes the program to proceed to step 208. At step 208, the computer 40 causes the switching transistor 64 to turn off. Thus, the solenoid 23a of water valve 23 is deenergized under control of the relay switch 63 to close the water valve 23 to interrupt the supply of water into the water tank 11. After processing at step 208, the computer 40 sets an initial flag IFLG to "0" at step 210 and finishes execution of the initial water supply cycle control routine at step 212.

Thereafter, the computer 40 determines at step 106 of FIG. 3 whether or not the float switch 34 is closed. When the level of water in tank 11 is still below the predetermined level, the float switch 34 is maintained in its open position. In this condition, the computer 40 determines a "No" answer at step 106 to repeat execution of the initial water supply cycle control routine. Accordingly, if the water tank 11 is not sufficiently supplied with fresh water because of no supply of the water due to user's error or suspension of the service water, the computer 40 will repeat execution of the initial water supply cycle control routine at step 104. In this condition, only the water valve 23 is opened, while the compressor 14, cooling fan 15 and water pump 25 are maintained in their deactivated conditions. This is useful to prevent overheating of the compressor 13 and unnecessary consumption of the electric power.

When the water tank 11 has been sufficiently supplied with fresh water to close the float switch 34, the computer 40 determines a "Yes" answer at step 106 and causes the program to proceed to step 108. At step 108, the computer 40 causes the switching transistor 56 to turn on for energizing the relay coil 55b. Thus, the normally open contact 55a of relay switch 55 is closed in response to energization of the relay coil 55b, and in turn, the relay coil 51b is energized to close the normally open contact 51a of relay switch 51. As a result, the electric motor 14a is activated to start the refrigerant compressor 14 for circulating the refrigerant through the condenser 16, expansion valve 17 and evaporator 13 and through the hot gas valve 18 in the refrigeration circuit.

Subsequently, the computer 40 executes a defrost/water supply cycle control routine at step 110 of the program. As shown in detail in FIGS. 5 and 6, the computer 40 initiates execution of the defrost/water supply cycle control routine at step 300 and causes the switching transistors 64, 58 at step 302 to turn on for energizing the relay coils 63*b*, 57*b*. Thus, the normally open contact 63*a* of relay switch 63 is turned on to energize the solenoid 23*a*, and the movable contact 57*a* of relay switch 57 is switched to energize the solenoid 18*a*. In turn, the water valve 23 is opened to permit the supply of fresh water to the watering pipe 21 from the water service pipe 22, while the hot gas valve 18 is opened to permit the supply of compressed hot gas into the evaporator 13 from the compressor 14. When the program proceeds to step 304, the computer 40 resets the back-up count value BUCT, count value WFCT for finish of water supply and water supply count value WICT to "0" and sets the temperature detection flag TFLG as "0". Thus, the count values BUCT, WFCT, WICT are successively counted up by "1" at each execution of the timer interruption program.

After processing at 304, the computer 40 repeats processing at step 306 to 324 to release ice cubes formed on the front surface 12*a* of ice making plate 12 and to supply ice making water into the water tank 11. Immediately after operation of the power source switch, however, any ice cubes may not be formed on the ice making plate 12. For this reason, the execution of the defrost/water supply cycle control routine will be described later. Assuming that the initial flag IFLG for supply of the water is maintained as "0" after processing at step 306–318, the computer 40 determines a "Yes" answer at step 320 and determines at step 322 whether the water supply count value WICT is more than or equal to a predetermined value $CT_5$ (for instance, a count value indicative of two minutes). If the count value WICT is less than the predetermined value $CT_5$, the computer 40 determines a "No" answer at step 322 and returns the program to step 306 to repeat processing at step 306, 308, 312. 318–322. When the water supply count value WICT becomes more than the predetermined value $CT_5$, the computer 40 determines a "Yes" answer at step 322 and causes the switching transistors 64, 58 at step 326 to turn off. Thus, the normally open contact 63*a* of relay switch 63 is opened to deenergize the solenoid 23*a* of water valve 23, while the movable contact 57*a* of relay switch 57 is switched over to deenergize the solenoid 18*a* of hot gas valve 18. As a result, the water valve 23 is closed to interrupt the supply of water into the watering pipe 21, and the hot gas valve 18 is closed to interrupt the supply of hot gas into the evaporator 13. After processing at step 326, the computer 40 sets the initial flag IFLG to "1" at step 328 and finishes the execution of the defrost/water supply cycle control routine at step 330.

Figure 7:
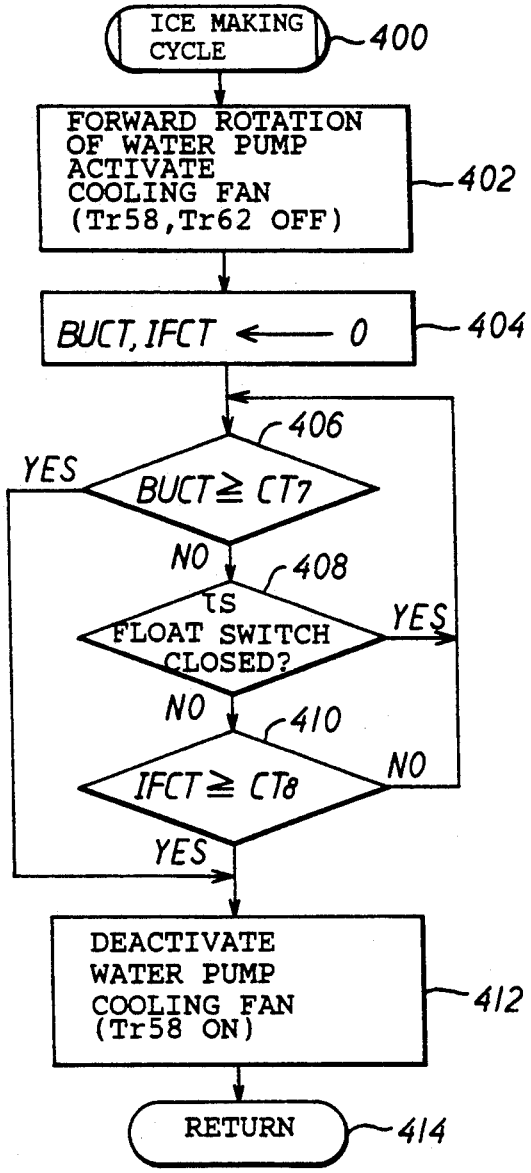

After execution of the defrost/water supply cycle control routine at step 110 of FIG. 3, the program proceeds to step 112 where the computer 40 determines whether the float switch 34 is closed or not. If the level of water in tank 11 is below the predetermined level, the computer 40 determines a "No" answer at step 112 and causes the program to proceed to step 104 for execution of the initial water supply cycle control routine. When the float switch 34 is closed by a sufficient amount of water supplied into tank 11, the computer 40 determines a "Yes" answer at step 112 and causes the program to proceed to step 114 for execution of the ice making cycle control routine shown in FIG. 7. During execution of the ice making cycle control routine, the computer 40 maintains the switching transistors 58 and 62 in a non-conductive state and turns on the switching transistor 56 to activate the electric motor 15*a* of cooling fan 15 under control of the relay switches 57, 61 and to effect forward rotation of the electric motor 25*a* of water pump 25 under control of the relay switches 57, 61. Thus, the watering pipe 24 is supplied with the ice making water from the water tank 11 through the water supply pipe 26 under forward rotation of the pump 25 and causes the supplied ice making water to flow down along the front surface 12*a* of ice making plate 12. In this instance, the hot gas valve 18 is closed under control of the relay switch 57, and the electric motor 14*a* of compressor 14 is activated under control of the relay switches 57, 51. Thus, the evaporator 12 is supplied with expanded refrigerant from the expansion valve 17 under operation of the compressor 14 to freeze the water flowing down along the front surface 12*a* of ice making plate 12. The water flowing down along the front surface 12*a* of plate 12 is progressively frozen by the evaporator 13 into ice cubes A, and the remaining water falls into the water tank 11.

After processing at step 402, the computer 40 resets the back-up count value BUCT and ice making count value IFCT respectively to the initial value "0". Subsequently, these count values BUCT, IFCT each are counted up by "1" at each execution of the timer interruption program. When the program proceeds to step 406, the computer 40 determines whether the back-up count value BUCT is more than or equal to a predetermined value $CT_7$ (for instance, a count value indicative of sixty minutes). At the following step 408, the computer 40 determines whether the float switch 34 is closed or not. Assuming that the back-up count value BUCT is still less than the predetermined value $CT_7$ after start of execution of the ice making cycle control routine, the computer 40 repeats processing at step 406 and 408 until the float switch 34 is opened by decrease of the water in tank 11. When the float switch 34 is opened, the computer 40 determines a "No" answer at step 408 and causes the program to proceed to step 410. At step 410, the computer 40 determines a "No" answer until the ice making count value IFCT becomes a predetermined value $CT_8$ (for instance, a count value indicative of five minutes). During the predetermined time defined by $CT_8$, the computer 40 repeats processing at step 406, 408 and 410. When the ice making count value IFCT becomes the predetermined value $CT_8$, the computer 40 determines a "Yes" answer at step 410 and causes the program to proceed to step 412. Such processing at step 410 is useful to avoid termination of the ice making cycle in a condition where ice cubes may not be sufficiently formed on the front surface 12*a* of ice making plate 12 due to shortage of the water in tank 11.

At step 412, the computer 40 causes the switching transistor 58 to turn on. Thus, the movable contact 57*a* is switched over to deactivate the electric motors 15*a*, 25*a* under control of the relay switch 57. As a result, the cooling fan 15 and water pump 25 are stopped to finish the ice making cycle. If the back-up count value BUCT exceeds the predetermined value $CT_7$ in a condition where the float switch 34 is still closed, the computer 40 determines a "Yes" answer at step 406 and causes the program to proceed to step 412 for completing of the ice making cycle control routine.

Figure 8:
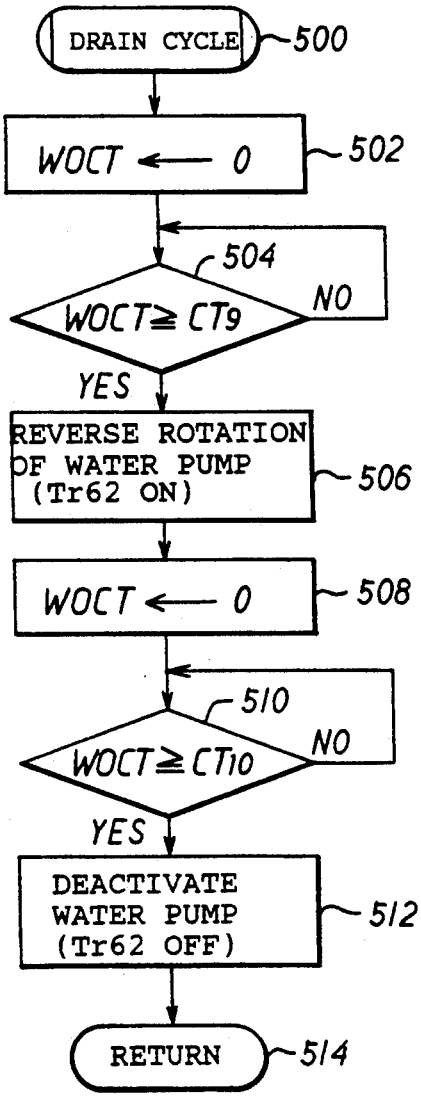

After completion of the ice making cycle control routine, the computer 40 causes the control program to proceed to step 116 shown in FIG. 3 for execution of a drain cycle control routine shown by a flow chart in FIG. 8. Thus, the computer 40 initiates execution of the drain cycle control routine at step 500 and sets at step 502 a discharge time count value WOCT to "0". At the following step 504, the computer 40 ceases progress of the control program until the discharge time count value WOCT becomes equal to or more than a predetermined value $CT_9$ (a count value indicative of two seconds). When the discharge time count value WOCT becomes equal to the predetermined value $CT_9$, the computer 40 determines a "Yes" answer at step 504 and causes the program to proceed to step 506. With such processing at step 504, the water pump 25 is maintained in its deactivated condition for the predetermined time defined by value $CT_9$. At step 506, the computer 40 causes the switching transistor 62 to turn on, while the switching transistor 58 is maintained in its deactivated condition by processing at step 412. Thus, the electric motor 25*a* is activated under control of the relay switches 57, 61 to effect reverse rotation of the water pump 25.

Subsequently, the computer 40 resets the count value WOCT to "0" at step 508 and ceases progress of the control program at step 510 until the count value WOCT becomes equal to or more than a predetermined value $CT_{10}$ (for instance, a count value indicative of ten to twenty seconds). Thereafter, the computer 40 causes the switching transistor 62 to turn off at step 512 for completion of the drain cycle control routine at step 514. As a result, the water pump 25 is stopped under control of the relay switch 61. In such a control as described above, the reverse rotation of water pump 25 is maintained for a period of time defined by the predetermined value $CT_{10}$ to supply the ice making water into the discharge pipe 27 from the water tank 11. Thus, the pressure valve 28 is opened to permit the ice making water discharged therethrough from the water tank 11 into the overflow pipe 31. In this instance, a portion of the ice making water is supplied into the sub-tank 33 through pipe 32 for washing the float switch 34.

Figure 5:
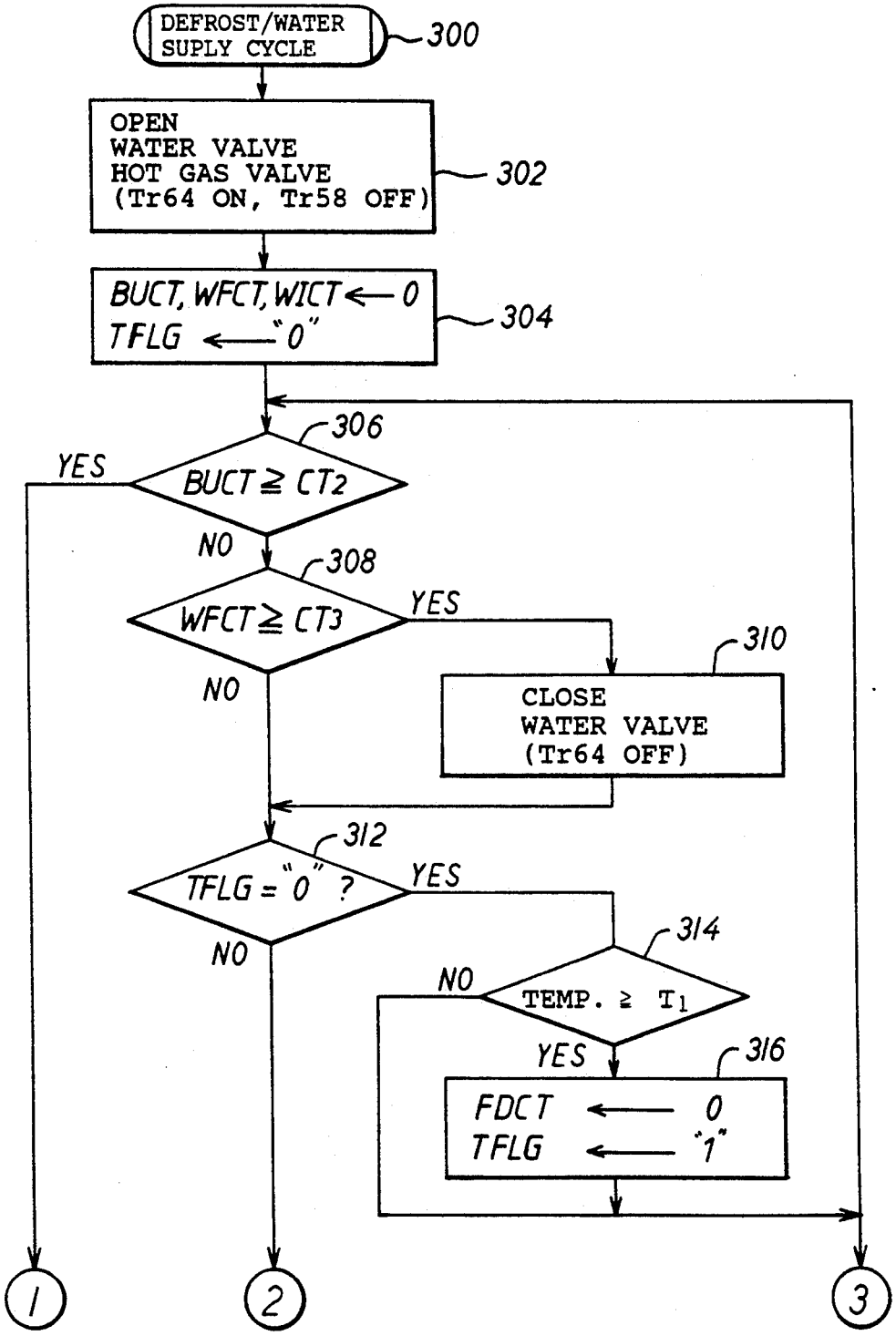
Figure 6:
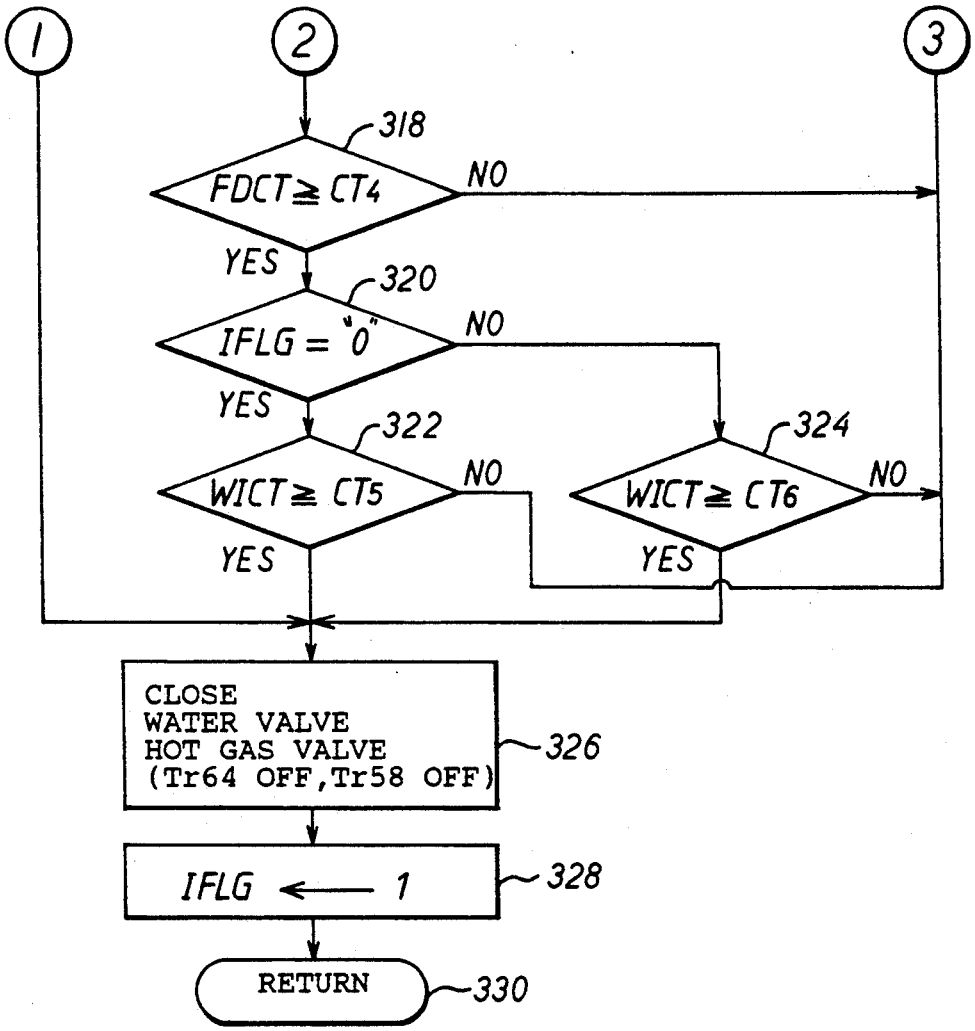

After the execution of the drain cycle control routine, the computer 40 returns the control program to step 110 for defrost/water supply cycle control routine shown in FIGS. 3, 5 and 6. During execution of the defrost-water supply control routine, fresh water from the water service pipe is supplied to the rear surface 12*b* of ice making plate 12 by processing at step 302, and the evaporator 13 is supplied with the hot gas from compressor 14 in the same manner as described above. In addition, the back-up count value BUCT, the count value WFCT for finish of the water supply and the water supply count value WICT each are reset to the initial value "0" by processing at step 304, and the temperature detection flag TFLG is also reset to "0" by processing at step 304. As a result, the ice making plate 12 is warmed by the fresh water and hot gas, and the count values BUCT, WFCT, WICT are counted up from "0". After processing at step 302 and 304, the computer 40 determines at step 306 whether the back-up count value BUCT is equal to or more than the predetermined value $CT_2$ (for instance, a count value indicative of twenty minutes) and determines at step 308 whether the count value WFCT is equal to or more than a predetermined value $CT_3$ (for instance, a count value indicative of six minutes). In this embodiment, the count values BUCT and WFCT are adapted to avoid a situation where the defrost-water supply cycle does not finish within a normal period of time due to the ambient temperature, the service water temperature and the like.

In a normal condition, the computer 40 determines a "No" answer respectively at step 306 and 308 and causes the program to proceed to step 312. At step 312, the computer 40 determines whether the temperature detection flag TFLG is "0" or not. In this instance, the temperature detection flag TFLG is previously reset at step 304 to "0". Thus, the computer 40 determines a "Yes" answer at step 312 and causes the program to proceed to step 314. At step 314, the computer 40 determines whether or not a refrigerant temperature detected by the thermal sensor 72 is equal to or higher than a predetermined temperature $T_1$. In this embodiment, the predetermined temperature $T_1$ is defined to correspond with a temperature (for instance, 9 degrees centigrade) at which the frozen ice cubes A start to be released from the ice making plate 12 at the defrost cycle. When the temperature of ice making plate 12 and evaporator coil 13 is still lower than the predetermined temperature $T_1$ at an initial stage of the defrost cycle, the computer 40 determines a "No" answer at step 314 and returns the program to step 306. During processing at step 306, 308, 312 and 314, the ice making plate 12 is supplied with the fresh water at its rear surface 12*b*, and the evaporator coil 13 is supplied with the hot gas. Thus, the temperature of ice making plate 12 and evaporator coil 13 gradually rises to release the frozen ice cubes a from the front surface 12*a* of ice making plate 12.

When the temperature at the outlet portion of evaporator coil 13 becomes equal to or higher than the predetermined temperature $T_1$, the computer 40 determines a "Yes" answer at step 314 and causes the program to proceed to step 316. At step 316, the computer 40 resets the defrost count value FDCT to the initial value "0" and changes the temperature detection flag TFLG to "1". Thereafter, the program is returned to step 306, and the defrost count value FDCT is counted up from "0" by execution of the timer interruption program.

When the program is returned to step 312 after processing at step 314, 316, the computer 40 determines a "No" answer and causes the program to proceed to step 318 shown in FIG. 6. At step 318, the computer 40 determines whether or not the defrost count value FDCT is equal to or more than a predetermined value $CT_4$ (for instance, a count value indicative of one minute). During lapse of a short time after the detected temperature reached the predetermined temperature $T_1$, the computer 40 determines a "No" answer at step 318 to repeat processing at step 306, 308, 312 and 318. When the defrost count value FDCT becomes equal to or more than the predetermined value $CT_4$, the computer 40 determines a "Yes" answer at step 318 and determines at step 320 whether or not the initial flag IFLG is "0". In this instance, the initial flag IFLG is previously set as "1" by processing at step 328 during previous execution of the defrost/water supply cycle control routine. Thus, the computer 40 determines a "No" answer at step 320 and determines at step 324 whether or not the water supply count value WICT is equal to or more than a predetermined value $CT_6$ indicative of a time necessary for supplying a sufficient amount of fresh water into the water tank 11 (for instance, three minutes). If the water supply count value WICT is more than the predetermined value $CT_6$, the computer 40 determines a "Yes" answer at step 324 and causes the program to proceed to step 326. Thus, the water valve 23 and hot gas valve 18 are closed by processing at step 326 in the same manner as described above, and the initial flag IFLG is set as "1" at step 328. As a result, the supply of fresh water to the rear surface 12*b* of ice making plate 12 and the supply of hot gas to the evaporator coil 13 are interrupted. At the end of the defrost cycle, the frozen ice cubes A are released from the ice making plate 12 and received by the water plate 36 to be introduced into and accumulated in the ice storage bin 35. Subsequently, the ice making cycle control routine and the drain cycle control routine will be executed in the same manner as described above.

If the water supply count value WICT is still less than the predetermined value $CT_6$ after the defrost count value FDCT became more than the predetermined value $CT_4$, the computer 40 determines a "No" answer at step 324 to repeat processing at step 306, 308, 312, 318, 320 and 324. When the water supply count value WICT increases more than the predetermined value $CT_6$ by execution of the timer interruption program, the computer 40 determines a "Yes" answer at step 324 and finishes the execution of the defrost-water supply cycle control routine after processing at step 326–330. Accordingly, even if the frozen ice cubes are released in a short time due to rise of the ambient temperature and/or the temperature of fresh water, the defrost water supply cycle will be continued for the period of time defined by the predetermined value $CT_6$. This is useful to store an amount of fresh water in tank 11 necessary for the following ice making cycle. In addition, the minimum time ($CT_5$=two minutes) for the first defrost cycle is determined by processing at step 320, 322 to be shorter than the minimum time ($CT_6$=three minutes) for the second defrost cycle since the water tank 11 is first supplied with fresh water at the initial water supply cycle described above.

When the temperature of the service water is extremely low, the supply of fresh water to the rear surface 12*b* of ice making plate 12 obstructs the defrost of the ice making plate 12. As a result, the frozen ice cubes A may not be released from the ice making plate 12. In this instance, the computer 40 determines a "No" answer at step 314 to repeat processing at step 306, 308, 312 and 314 during which the count value WFCT is counted up. When the count value WFCT becomes equal to or more than a predetermined value $CT_3$ (for instance, a count value indicative of six minutes), the computer 40 determines a "Yes" answer at step 308 and causes the switching transistor 64 to turn off at step 310. Thus, the solenoid 23*a* of water valve 23 is deenergized under control of the relay switch 63 so that the water valve 23 is closed to interrupt the supply of fresh water to the rear surface 12*b* of ice making plate 12. Under such a condition, the hot gas valve 18 is maintained in its open position so that the temperature of ice making plate 12 rises under supply of the hot gas to the evaporator coil 13 for completion of the defrost of ice cubes.

When the ambient temperature is extremely low, the temperature detected by thermal sensor 72 will not rise higher than the predetermined temperature $T_1$ after release of the ice cubes A from the front surface 12*a* of ice making plate 12. In this instance, the computer 40 determines a "No" answer at step 314 to repeat processing at step 306–314 after stopping the supply of fresh water. In such a condition, the back-up count value BUCT is counted up during processing at step 306–314. When the back-up count value BUCT becomes equal to or more than a predetermined value $CT_2$ (for instance, a count value indicative of twenty minutes), the computer 40 determines a "Yes" answer at step 306 and causes the program to proceed to step 326. Thus, the defrost cycle finishes at step 326 in the same manner as described above.

After finish of the defrost/water supply cycle, the computer 40 determines at step 112 whether the float switch 34 is closed or not. When the water tank 11 is filled with the fresh water to close the float switch 34, the computer 40 determines a "Yes" answer at step 112 and causes the program to proceed to step 114 for execution of the ice making cycle control routine. Subsequently, the defrost/water supply cycle, the ice making cycle and the drain cycle will be carried out in sequence for automatically making ice cubes.

If the water tank 11 is not filled with fresh water due to suspension of the service water after processing at step 110, the float switch 34 may not be closed. In this instance, the computer 40 determines a "No" answer at step 112 and returns the program to step 104 for the initial water supply cycle control routine. Thus, the computer 40 determines a "No" answer at step 106 until the water tank 11 is filled with fresh water by execution of the initial water supply cycle control routine. Accordingly, the computer 40 repeats processing at step 104 and 106 in a condition where the water pump 25 and compressor 14 are maintained in their deactivated conditions. This is unnecessary to avoid useless consumption of electric power and overheating of the compressor 14.

a) First Modification

Figure 10:
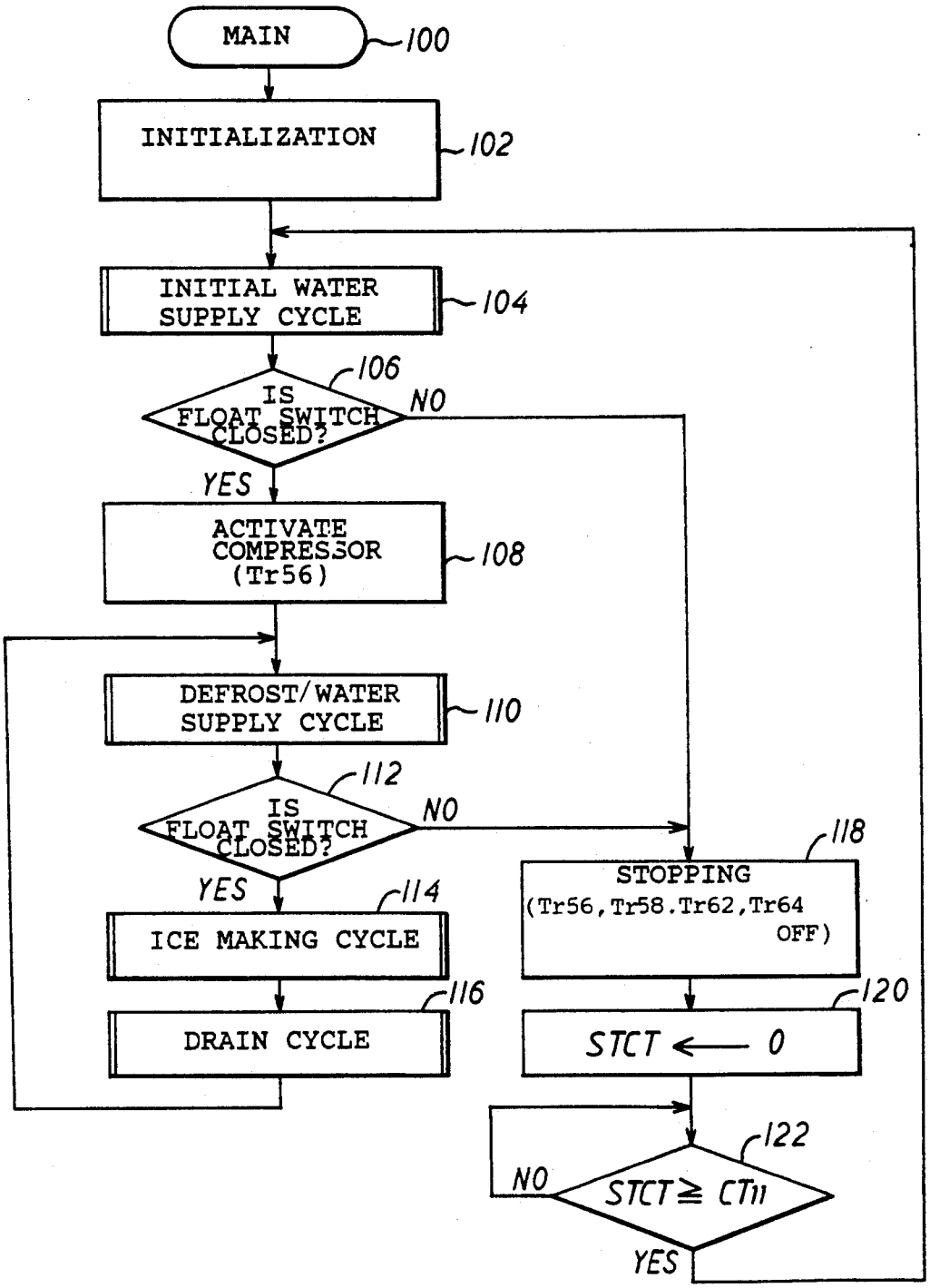
FIGS. 10 and 11 illustrate a flow chart of a first modification of the control program.
Figure 11:
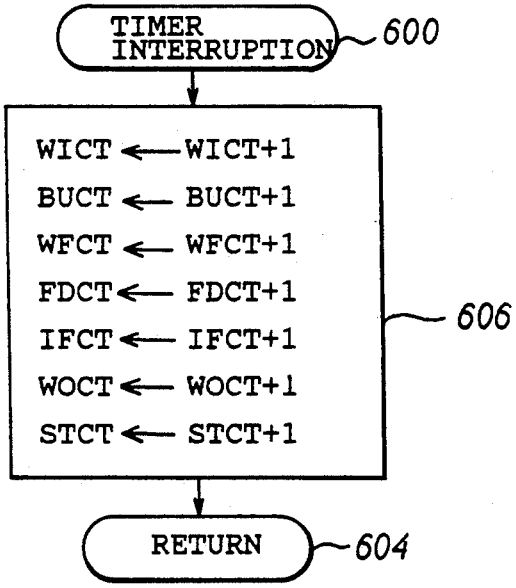

Hereinafter, a first modification of the above embodiment will be described. In this modification, the computer 40 is arranged to store a modified program shown by a flow chart in FIG. 10, thereby replacing the program of FIG. 3 and to store a modified timer interruption program shown by a flow chart in FIG. 11, thereby replacing the timer interruption program of 9. Assuming that in this modification the float switch 34 is not closed due to shortage of the water in tank 11 after the initial water supply cycle or the defrost/water supply cycle, the computer 40 determines a "No" answer at step 106 or 112 and causes the program to proceed to step 118. At step 118, the computer 40 causes all the switching transistors 56, 58, 62, 64 to be turned off. In this instance, the electric motors 14*a*, 25*a*, 15*a* and the solenoids 18*a*, 23*a* are deenergized under control of the relay switches 51, 55, 57, 61, 63 to deactivate the compressor 14, water pump 25 and cooling fan 15 and to close the hot gas valve 18 and water valve 23. As a result, the supply of fresh water through water valve 23 is interrupted, and the operation of the ice making machine is stopped.

Subsequently, the computer 40 sets a stop count value STCT as "0" at step 120 and ceases progress of the program at step 122 until the stop count value STCT becomes equal to or more than a predetermined value $CT_{11}$ (for instance, a count value indicative of 60 to 120 minutes). The stop count value STCT is counted up at step 606 in each execution of the timer interruption program shown in FIG. 11. When the period of time defined by the predetermined value $CT_{11}$ lapses after processing at step 120, the computer 40 determines a "Yes" answer at step 122 and causes the program to proceed to step 104 for execution of the initial water supply routine. At step 104, the initial water supply routine is executed by the computer 40 in the same manner as described above for initial supply of fresh water into the water tank 11. With this modification, the execution frequency of the initial water supply routine at step 104 will be reduced even if the water tank 11 may not be supplied with fresh water due to suspension of the service water for a long time or may not be filled with a sufficient amount of fresh water due to a leak in tank 11. This is useful to avoid unnecessary supply of the electric power to the solenoid 23*a* of water valve 23.

b) Second Modification

Figure 12:
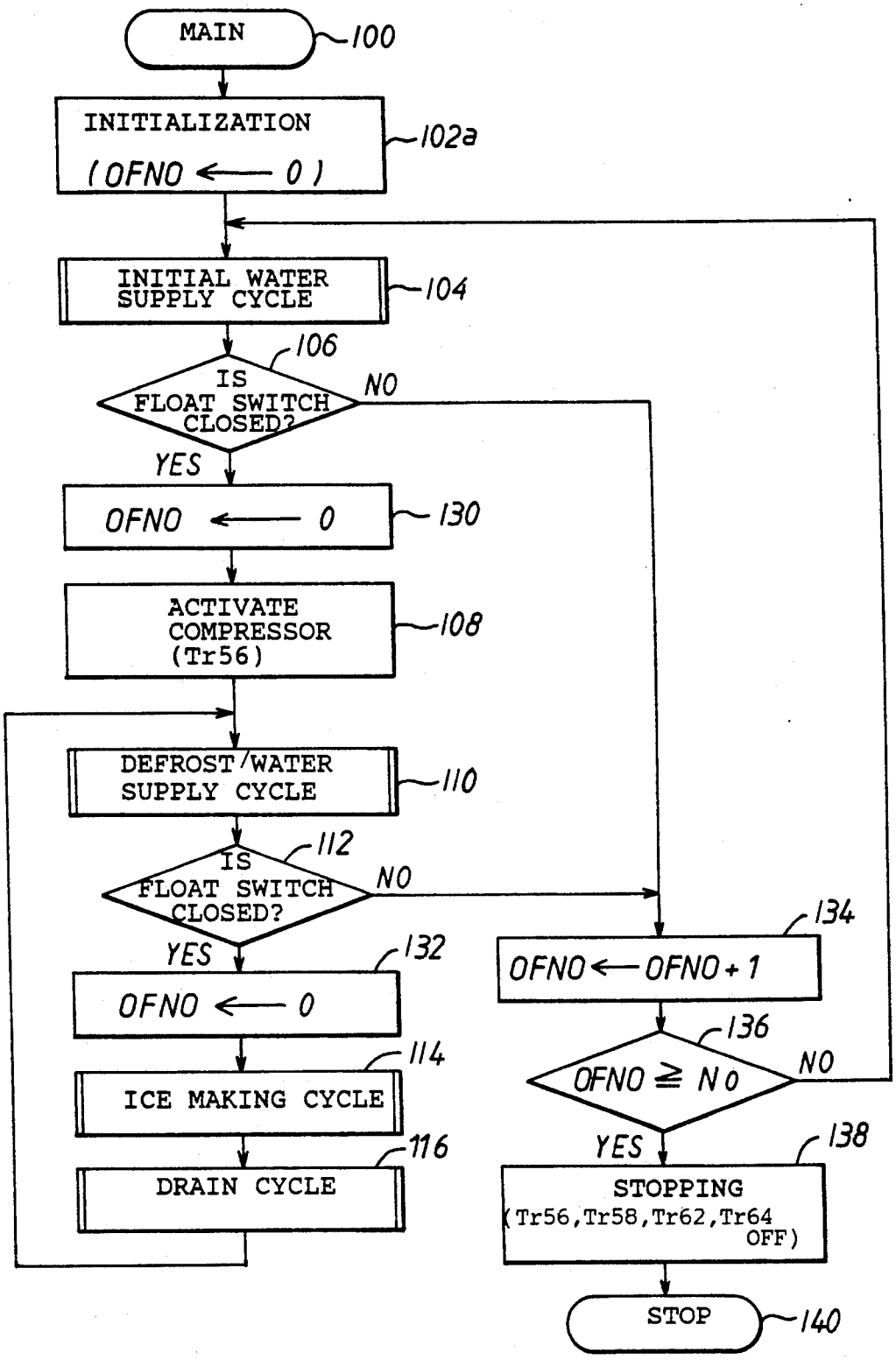
FIG. 12 is a flow chart of a second modification of the control program.

A second modification of the above embodiment will be described hereinafter. In this modification, the computer 40 is arranged to store a modified program shown by a flow chart in FIG. 12, thereby replacing the program of FIG. 3. In execution of the program, the computer 40 sets a count value OFNO to an initial value "0" at step 102*a*. The count value OFNO represents the number of off conditions detected by the float switch 34. Assuming that the float switch 34 has been turned on at step 106 or 112 after processing of the initial water supply routine at step 104 or processing of the defrost-/water supply cycle control routine at 110, the computer 40 sets the count value OFNO to the initial value "0" at step 130 or 132. When the water tank 11 is sufficiently filled with fresh water by processing of the initial water supply cycle control routine and the defrost-/water supply cycle control routine in normal operation, the computer 40 executes processing at step 110 to 116 in the same manner as described above to automatically produce ice cubes in the making machine.

If the water tank 11 is not sufficiently filled with fresh water after execution of the initial water supply routine at step 104 due to leakage of the fresh water or suspension of the service water, the computer 40 determines a "NO" answer at step 106 and causes the program to proceed to step 134. Thus, the computer 40 adds "1" to the count value OFNO at step 134 and compares the count value OFNO with a predetermined value $N_0$ (for instance, a count value indicative of 5 or 6) at step 136. Immediately after first execution of the initial water supply routine at step 104, the count value OFNO is set to "1" by processing at step 134. In this instance, the computer 40 determines a "NO" answer at step 136 and returns the program to step 104 for execution of the initial water supply routine. Accordingly, if the float switch 34 is maintained in its open position due to leakage of the fresh water or suspension of the service water, the computer 40 repeats processing at step 104, 106, 134, 136 until the count value OFNO becomes equal to or more than the predetermined value $N_0$.

When the count value OFNO becomes more than the predetermined value $N_0$, the computer 40 determines a "YES" answer at step 136 and causes the switching transistors 56, 58, 62, 64 at step 138 to turn off. Thus, the electric motors 14*a*, 25*a*, 15*a* and the solenoids 18*a*, 23*a* are deenergized to deactivate the compressor 14, water pump 25 and cooling fan 15 and to close the hot gas valve 18 and water valve 23. Accordingly, if the water tank 11 may not be sufficiently filled with fresh water due to suspension of the service water, the initial water supply routine will be executed by the number of times defined by the predetermined value $N_0$. During execution of the initial water supply cycle control routine, only the water valve 23 is opened while the compressor 14, cooling fan 15 and water pump 25 are maintained in their deactivated conditions. This is useful to prevent overheating of the compressor 14 and unnecessary consumption of the electric power. If the shortage of water in tank 11 is temporarily caused, the float switch 34 will be closed by rise of the water level during repetitive execution of the initial water supply routine. In this instance, the computer 40 determines a "YES" answer at step 106 and causes the program to proceed to 130 for execution at the following step. Accordingly, if the shortage of water in tank 11 is solved in a short time, the defrost/water supply cycle, the ice making cycle and the drain cycle are carried out under control of the computer 40 for production of ice cubes.

If the water tank 11 is not sufficiently filled with fresh water due to leakage of the fresh water or suspension of the service water after processing of the defrost/water supply cycle control routine at step 110, the computer 40 determines a "NO" answer at step 112 and causes the program to proceed to step 134 for processing at step 136. In this instance, the count value OFNO is continuously set to "0" at step 132 during processing at step 110 to 116. Accordingly, the count value OFNO is set to "1" by processing at step 134 prior to first processing at step 136. Thus, the computer 40 determines a "NO" answer at step 136 and returns the program to step 104 for processing at step 104, 106, 134, 136.

Although in the second modification the predetermined value $N_0$ for processing at 136 has been defined as "5" or "6", it may be defined as "1". In such a case, the count value OFNO becomes more than "1" by processing at step 134 when the computer 40 determined a "NO" answer at step 106 or 112. Accordingly, if the answer at step 106 or 112 was determined as "No" due to shortage of the fresh water in tank 11, the computer 40 determines a "Yes" answer at step 136 and executes processing at step 138 for stopping the ice making machine.

c) Third Modification

Figure 13:
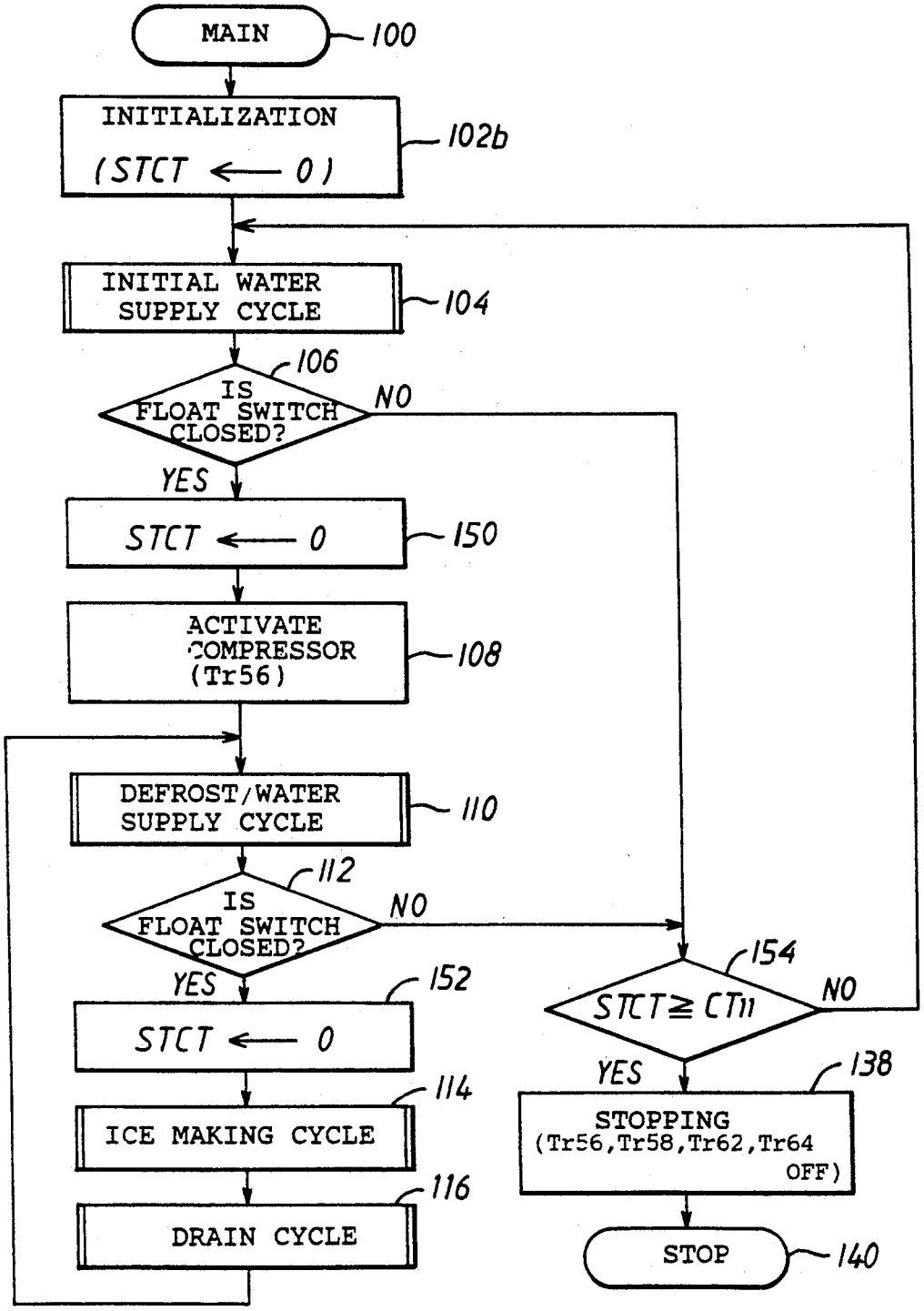
FIG. 13 is a flow chart of a third modification of the control program.

Hereinafter, a third modification of the above embodiment will be described. In this modification, the computer 40 is arranged to store a modified program shown by a flow chart in FIG. 13, thereby replacing the program of FIG. 3 and to store a modified program shown by the flow chart in FIG. 11, thereby replacing the timer interruption program of FIG. 9. The modified program is designed to measure a duration of the initial water supply cycle thereby to deactivate the ice making machine when the measured duration becomes a predetermined value $CT_{11}$ (for instance, a value indicative of ten minutes). In execution of the modified program, a stop count value STCT for measurement of a duration of the initial water supply cycle is set as "0" respectively at step 102*b*, 150 and 152 shown in FIG. 13 and is counted up by "1" at step 606 in each execution of the timer interruption program shown in FIG. 11. When the supply of fresh water into tank 11 is normally conducted, the stop count value STCT does not increase since it is set as "0" respectively at step 150 and 152. If the water tank 11 is not sufficiently filled with fresh water by processing of the initial water supply routine at step 104 or the defrost/water supply cycle control routine at step 110, the computer 40 determines a "No" answer at step 106 or 112 and repeats processing at step 154, 104, 106 or at step 154, 104, 106, 150-112. As a result, the stop count value STCT gradually increases during the repetitive processing at step 154. When the stop count value STCT becomes equal to or more than the predetermined value $CT_{11}$, the computer 40 determines a "YES" answer at step 154 and causes the program to proceed to step 138 for stopping the ice making machine. Accordingly, if the water tank 11 is not filled with the fresh water, the ice making machine is deactivated to prevent overheating of the compressor 14 and unnecessary consumption of electric power. If shortage of the water in tank 11 is solved in a short time, the defrost/water supply cycle, the ice making cycle and the drain cycle are automatically carried out under control of the computer 40 for production of ice cubes.

Although in the embodiment and modifications noted above there has not been provided any particular means for informing the user of shortage of the fresh water in tank 11, an indication device or an alarm device may be adapted to inform the user of shortage of the fresh water in tank 11. In this case, the indication device or alarm device is arranged to be activated under control of the computer 40 immediately after the "No" answer was determined at step 106 or 112 shown in FIGS. 3, 10, 12 and 13.

What is claimed is:

1. An electric control apparatus for an ice making machine having an upright ice making plate arranged above a water tank, an evaporator mounted to a rear surface of the ice making plate, a refrigeration circuit including a compressor, a cooling device and an expansion valve for circulating refrigerant into the evaporator, a hot gas valve disposed within a bypass line of the refrigerant circuit to be opened for supplying hot gas from the compressor into the evaporator, a water pump arranged to supply fresh water from the water tank to a front side upper portion of the ice making plate, and a water valve arranged to control the supply of fresh water from an external source of water to a rear side upper portion of the ice making plate, the electric control apparatus comprising defrost/water supply cycle control means for opening the hot gas valve and water valve for a predetermined time in a condition where the compressor is being activated while the water pump is deactivated, ice making cycle control means for activating the water pump for a predetermined time in a condition where the compressor is being activated while the hot gas valve and water valve are closed, and means for alternately conducting a defrost/water supply cycle and an ice making cycle under control of the defrost-/water supply cycle control means and the ice making cycle control means, wherein the electric control apparatus further comprises:

initial water supply cycle control means for opening the water valve for a predetermined time prior to the defrost/water supply cycle and the ice making cycle in a condition where the compressor and water pump are deactivated;

a water level sensor mounted within the water tank for detecting whether or not the level of water in the water tank is more than a predetermined level;

first checkup means for permitting operation of the defrost/water supply cycle and the ice making cycle when the level of water in the water tank is more than the predetermined level after an initial water supply cycle conducted under control of the initial water supply control means and for repeating operation at the initial water supply cycle when the level of water in the water tank is less than the predetermined level; and second checkup means for permitting operation of the ice making cycle when the level of water in the water tank is more than the predetermined level after the defrost/water supply cycle and for repeating operation at the initial water supply cycle when the level of water in the water tank is less than the predetermined level after the defrost/water supply cycle.

2. An electric control apparatus as claimed in claim 1, further comprising control means for deactivating the compressor and water pump and closing the hot gas valve and water valve for a predetermined time prior to operation at the initial water supply cycle conducted under control of the first checkup means.

3. An electric control apparatus for an ice making machine having an upright ice making plate arranged above a water tank, an evaporator mounted to a rear surface of the ice making plate, a refrigeration circuit including a compressor, a cooling device and an expansion valve for circulating refrigerant into the evaporator, a hot gas valve disposed within a bypass line of the refrigerant circuit to be opened for supplying hot gas from the compressor into the evaporator, a water pump arranged to supply fresh water from the water tank to a front side upper portion of the ice making plate, and a water valve arranged to control the supply of fresh water from an external source of water to a rear side upper portion of the ice making plate, the electric control apparatus comprising defrost/water supply cycle control means for opening the hot gas valve and water valve for a predetermined time in a condition where the compressor is being activated while the water pump is deactivated, ice making cycle control means for activating the water pump for a predetermined time in a condition where the compressor is being activated while the hot gas valve and water valve are closed, and means for alternately conducting a defrost/water supply cycle and an ice making cycle under control of the defrost-/water supply cycle control means and the ice making cycle control means, wherein the electric control apparatus further comprises:

initial water supply cycle control means for opening the water valve for a predetermined time prior to the defrost/water supply cycle and the ice making cycle in a condition where the compressor and water pump are deactivated;

a water level sensor mounted within the water tank for detecting whether or not the level of water in the water tank is more than a predetermined level;

first checkup means for permitting operation of the defrost/water supply cycle and the ice making cycle when the level of water in the water tank is more than the predetermined level after an initial water supply cycle conducted under control of the initial water supply control means and for stopping the ice making machine when the level of water in the water tank is less than the predetermined level.

4. An electric control apparatus as claimed in claim 3, further comprising second checkup means for permitting operation at the ice making cycle when the level of water in the water tank is more than the predetermined level after the defrost/water supply cycle and for stopping the ice making machine when the level of water in the water tank is less than the predetermined level after the defrost/water supply cycle.

5. An electric control apparatus for an ice making machine having an upright ice making plate arranged above a water tank, an evaporator mounted to a rear surface of the ice making plate, a refrigeration circuit including a compressor, a cooling device and an expansion valve for circulating refrigerant into the evaporator, a hot gas valve disposed within a bypass line of the refrigerant circuit to be opened for supplying hot gas from the compressor into the evaporator, a water pump arranged to supply fresh water from the water tank to a front side upper portion of the ice making plate, and a water valve arranged to control the supply of fresh water from an external source of water to a rear side upper portion of the ice making plate, the electric control apparatus comprising defrost/water supply cycle control means for opening the hot gas valve and water valve for a predetermined time in a condition where the compressor is being activated while the water pump is deactivated, ice making cycle control means for activating the water pump for a predetermined time in a condition where the compressor is being activated while the hot gas valve and water valve are closed, and means for alternately conducting a defrost/water supply cycle and an ice making cycle under control of the defrost/water supply cycle control means and the ice making cycle control means, wherein the electric control apparatus further comprises:

initial water supply cycle control means for opening the water valve for a predetermined time prior to the defrost/water supply cycle and the ice making cycle in a condition where the compressor and water pump are deactivated;

a water level sensor mounted within the water tank for detecting whether or not the level of water in the water tank is more than a predetermined level;

first checkup means for permitting operation of the defrost/water supply cycle and the ice making cycle when the level of water in the water tank is more than the predetermined level after an initial water supply cycle conducted under control of the initial water supply control means and for repeating operation of the initial water supply cycle when the level of water in the water tank is less than the predetermined level;

counting means for counting the number of repeat times of the initial water supply cycle conducted under control of the first checkup means; and means for stopping the ice making machine when the counted number of repeat times of the initial water supply cycle becomes a predetermined value.

6. An electric control apparatus as claimed in claim 5, further comprising second checkup means for permitting operation at the ice making cycle when the level of water in the water tank is more than the predetermined level after the defrost/water supply cycle and for repeating operation at the initial water supply cycle when the level of water in the water tank is less than the predetermined level after the defrost/water supply cycle.

7. An electric control apparatus for an ice making machine having an upright ice making plate arranged above a water tank, an evaporator mounted to a rear surface of the ice making plate, a refrigeration circuit including a compressor, a cooling device and an expansion valve for circulating refrigerant into the evaporator, a hot gas valve disposed within a bypass line of the refrigerant circuit to be opened for supplying hot gas from the compressor into the evaporator, a water pump arranged to supply fresh water from the water tank to a front side upper portion of the ice making plate, and a water valve arranged to control the supply of fresh water from an external source of water to a rear side upper portion of the ice making plate, the electric control apparatus comprising defrost/water supply cycle control means for opening the hot gas valve and water valve for a predetermined time in a condition where the compressor is being activated while the water pump is deactivated, ice making cycle control means for activating the water pump for a predetermined time in a condition where the compressor is being activated while the hot gas valve and water valve are closed, and means for alternately conducting a defrost/water supply cycle and an ice making cycle under control of the defrost/water supply cycle control means and the ice making cycle control means, wherein the electric control apparatus further comprises:

initial water supply cycle control means for opening the water valve for a predetermined time prior to the defrost/water supply cycle and the ice making cycle in a condition where the compressor and water pump are deactivated;

a water level sensor mounted within the water tank for detecting whether or not the level of water in the water tank is more than a predetermined level;

first checkup means for permitting operation of the defrost/water supply cycle and the ice making cycle when the level of water in the water tank is more than the predetermined level after an initial water supply cycle conducted under control of the initial water supply control means and for repeating operation at the initial water supply cycle when the level of water in the water tank is less than the predetermined level;

measuring means for measuring a duration of the initial water supply cycle; and means for stopping the ice making machine when the measured duration reaches a predetermined time.

8. An electric control apparatus as claimed in claim 7, further comprising second checkup means of permitting operation at the ice making cycle when the level of water in the water tank is more than the predetermined level after the defrost/water supply cycle and for repeating operation at the initial water supply cycle when the level of water in the water tank is less than the predetermined level after the defrost/water supply cycle.

* * * * *